US006682165B2

(12) United States Patent
Yearout

(10) Patent No.: US 6,682,165 B2
(45) Date of Patent: Jan. 27, 2004

(54) WIPING FLUID SPRAY SYSTEM FOR INKJET PRINTHEAD

(75) Inventor: Russell P. Yearout, Brush Prairie, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/015,821

(22) Filed: Oct. 30, 2001

(65) Prior Publication Data

US 2003/0081047 A1 May 1, 2003

(51) Int. Cl.[7] ..... B41J 2/165
(52) U.S. Cl. ..... 347/28; 347/29; 347/33
(58) Field of Search ..... 347/28, 33, 22, 347/34, 29

(56) References Cited

U.S. PATENT DOCUMENTS

| | | | | | |
|---|---|---|---|---|---|
| 5,495,272 | A | * | 2/1996 | Yamaguchi | 347/28 |
| 5,635,965 | A | | 6/1997 | Purwins et al. | 347/31 |
| 5,706,038 | A | | 1/1998 | Jackson et al. | 347/33 |
| 5,963,228 | A | | 10/1999 | Purwins | 347/31 |
| 6,017,110 | A | | 1/2000 | Jackson | 347/33 |
| 6,158,838 | A | * | 12/2000 | Capurso | 347/28 |
| 6,193,353 | B1 | | 2/2001 | Vives et al. | 347/29 |

* cited by examiner

*Primary Examiner*—Thinh Nguyen

(57) ABSTRACT

Techniques for dispensing a wiper cleaning fluid onto a printhead ink-ejecting nozzles, wherein the fluid is sprayed onto the nozzles, effectively dissolving ink and residue on the surface.

26 Claims, 2 Drawing Sheets

WIPING FLUID SPRAY SYSTEM FOR INKJET PRINTHEAD

TECHNICAL FIELD OF THE DISCLOSURE

This invention relates to techniques for cleaning surfaces of printhead nozzle arrays in inkjet printheads.

BACKGROUND OF THE DISCLOSURE

It is known to wipe surfaces of nozzle arrays of an inkjet printhead, and to apply a liquid to assist in the wiping process. Some techniques have employed polyethylene wick material and a fibrous reservoir to contain and dispense wet wiping fluid to the wipers. Due to the geometry of the service station, the amount of fluid that can be contained is limited. Extra time (e.g. a few seconds) can be required for the picking of the wet fluid, i.e. transferring the fluid from the wick to the wiper.

SUMMARY OF THE DISCLOSURE

Techniques are disclosed for dispensing a wiper cleaning fluid onto ink-ejecting nozzles of a printhead, wherein the fluid is sprayed or directed as a fluid stream onto the nozzles, effectively dissolving ink residue.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

Figure 1:
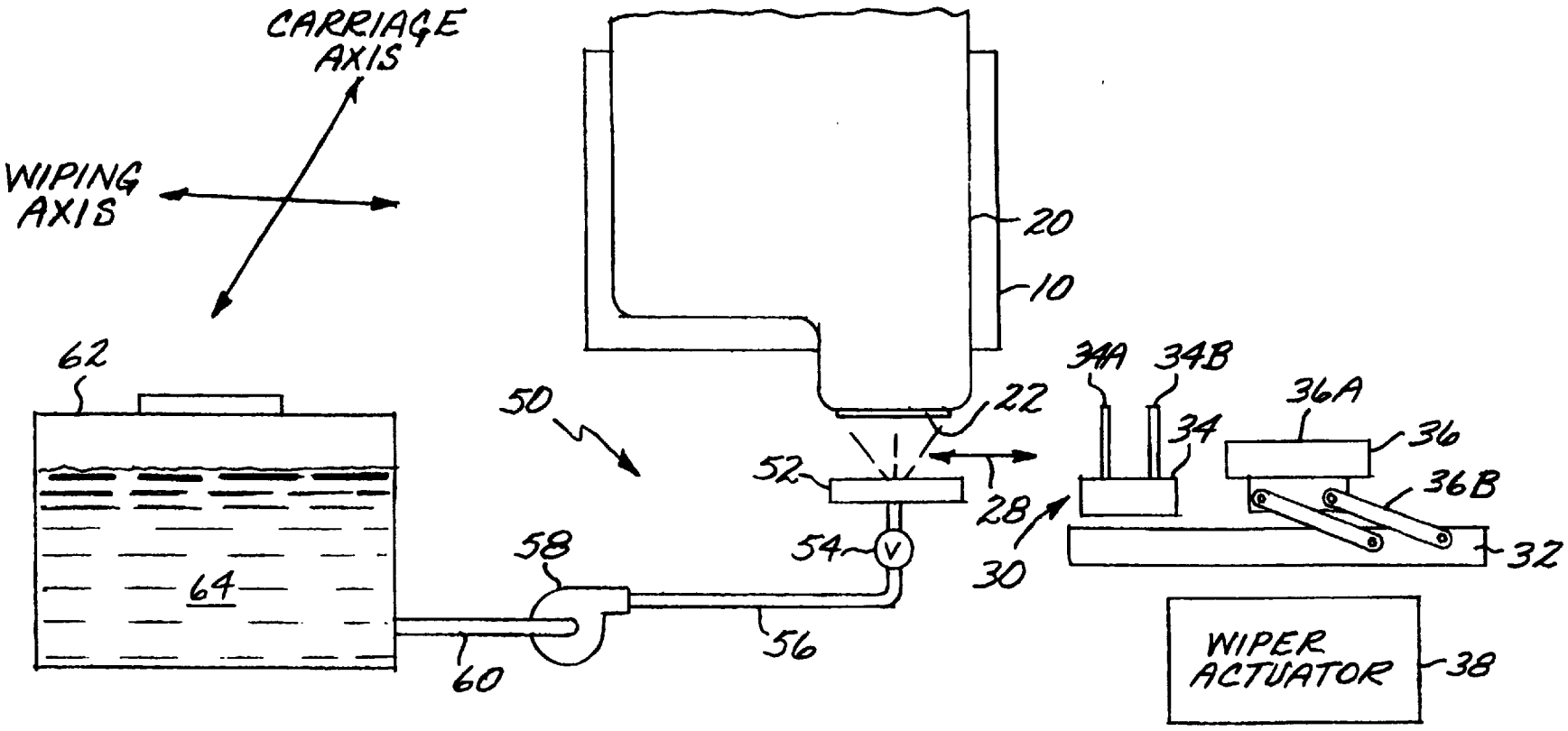
FIG. 1 is a schematic view of a spray system for dispensing wet wiping fluid in a printing system.

A spray system 50 for dispensing wet wiping fluid in accordance with an aspect of the invention is diagrammatically illustrated in FIG. 1. An inkjet printhead 20 has mounted thereon a printhead 22 comprising ink-ejecting nozzles, e.g. formed in a nozzle plate. In one typical application, the printhead 20 can be employed in an inkjet printing system with a traversing carriage 10, and the printhead mounted in the carriage.

A service station 30 is located at one end of the carriage travel path. The service station 30 includes a sled 32 which carries a wiper raft 34 which carries a set of wiper blades 34A, 34B, and a capping mechanism 36 which includes a nozzle array cap 36A and an elevator mechanism 36B for lifting the cap 36A to a capping position. A wiper actuator 38 moves the sled along the wiping axis 28 for a wiping procedure, so that the wiper blades are passed in wiping contact past the stationary printhead nozzles. In this exemplary embodiment, the wiping axis is transverse to the carriage travel path or axis, as indicated by the axis legend in FIG. 1. The actuator 38 can also lift the sled; this motion can alternatively be provided by a cam surface or other techniques known in the art. Alternatively, the wiper blades could be mounted so that the carriage motion is used to provide the wiping force. In such an arrangement, the wiper sled is held stationary while the carriage moves the printhead along the carriage axis and through a wiping zone, so that the printhead nozzle plate is passed through the wiping zone and engagement with the wiper blades. The wipers and cap are conventional tools to maintain printhead health.

The spray system 50 includes, in an exemplary embodiment, a spray nozzle structure or manifold of nozzles 52 which is fluidically coupled to a pump or actuator 58 through a fluid path or conduit 56. In one embodiment, the nozzle structure provides a single nozzle, typically for a single printhead. In another embodiment, the nozzle structure is a group of nozzles ganged together in a manifold structure in order to be able to deliver wiping fluid to a larger set of printheads. The spray nozzle structure 52 can be configured to emit a relatively fine spray of the wiping fluid onto the nozzle orifice plate of the printhead, or to direct a heavier spray or stream of the wiping fluid.

The pump 58 in an exemplary embodiment is a diaphragm pump with a solenoid which pushes on the diaphragm, although many other types of pumps or metering devices could alternatively be employed, such as a valve that controls flow and a means for pressurizing the wiping fluid. A check valve or fluid seal 54 may optionally be placed adjacent to the nozzle 52 in the fluid path to prevent wiping fluid evaporation for some applications. For other applications, particularly those in which the spray nozzle orifice opening size is relatively small, and the amount of evaporation from the spray nozzle is insignificant, the check valve or fluid seal 54 can be omitted. The check valve has a break pressure which must be exceeded before fluid commences through the valve. Alternatively, this optional function can be provided by a valve such as a pinch valve, ball valve or solenoid-actuated valve.

The pump or actuator 58 is fluidically coupled to a reservoir 62 of wiping fluid through a fluid path or conduit 60. The reservoir is sealed to prevent evaporation, and can include a removable cap, lid, membrane or septum to allow a user to replenish the supply of wiping fluid 64.

In an exemplary embodiment, the fluid paths or conduits 56, 60 are in the form of lengths of tubing, which allow the reservoir and pump to be positioned at locations in the printer housing away from the service station. Alternatively, the reservoir and pump can be fabricated in a single housing mounted with the spray nozzle structure.

In an alternate embodiment, the pressure head necessary to develop a suitable spray or stream is developed by a gravity arrangement, wherein the reservoir is positioned at a height well above the spray nozzle structure so as to develop a pressure head at the valve 54. In this case, the valve is opened and closed to turn the spray or stream on and off.

The wiping fluid is a solvent for ink, and in this exemplary embodiment is water, although other fluids could alternatively be employed. Alternative fluids include, by way of example only, mixtures of water and surfactants, or solvents other than water. The particular fluid composition will depend on the ink composition used by the printhead. For inks used in thermal inkjet printing, water is a particularly effective solvent. A wet spray of water is effective at dissolving ink, and does not leave behind a non-volatile residue. Thus, desirable characteristics of the wiping fluid are that it be a solvent for the ink used in the printing system, and that it not include non-volatile components which would be left as a residue after drying. For some applications and ink formulations, however, it may be necessary to use solvents which do not fully evaporate and leave a residue.

Figure 2:
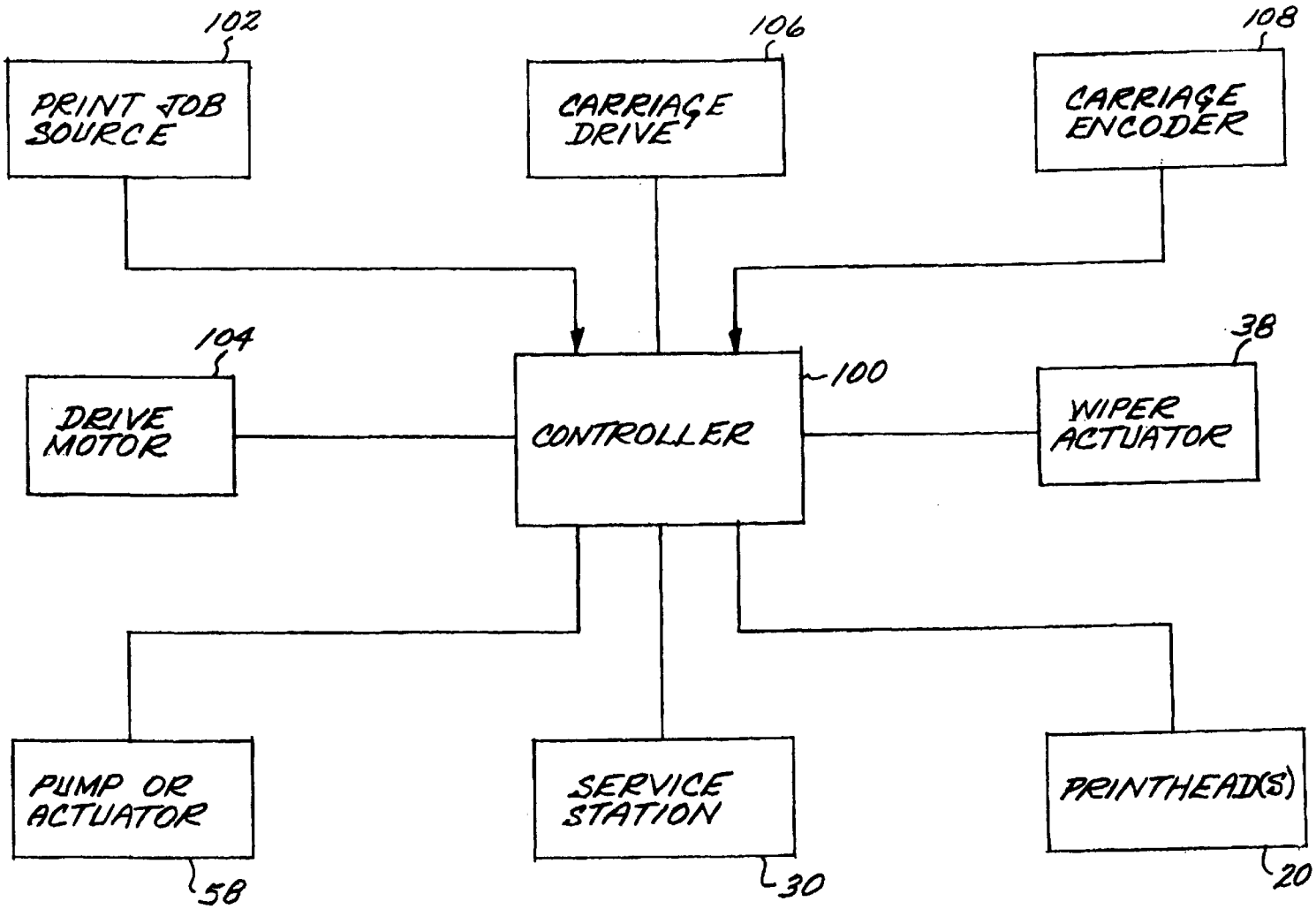
FIG. 2 is a schematic block diagram of the control system for an exemplary inkjet printer employing the spray system of FIG. 1.

FIG. 2 is a schematic block diagram of the control system for an exemplary inkjet printer employing the spray system 50 of FIG. 1. A controller 100 such as a microcomputer receives print job commands and data from a print job source 102, which can be a personal computer, digital camera or other known source of print jobs. The controller activates a drive motor system 104 to advance a print medium to a print zone. A carriage drive 106 is driven by the controller to position the carriage 10 for commencement of a print job, and to scan the carriage along slider rods. As this is done firing pulses are sent to the printhead(s) 20. The controller receives encoder signals from the carriage encoder 108 to provide position data for the carriage. The controller is programmed to advance incrementally the sheet to position the print medium for successive swaths, and to eject the completed print medium into an output tray.

The controller 100 also controls the service station 30 and the spray system 50. The controller sends control signals to the carriage drive 106 and the pump or actuator 58, to move the printhead 20 over the spray dispenser nozzle 52 and cause a spray of the wiping liquid to be ejected from the nozzle 52 onto the nozzle plate 22 of the printhead 20. The carriage 10 need not be held in a stationary position while the fluid is ejected onto the printhead nozzle plate, thus saving some time in servicing the printhead. Of course, in some applications, the carriage 10 may be brought to a stationary position while the fluid is sprayed onto the nozzle plate. This could be useful in situations in which a heavy application of the fluid is desired. With the wiping fluid dispensed onto the printhead nozzle plate to wet the nozzles and dissolve accumulated residue, the carriage can be moved to the service station 30, and the service station actuator 38 activated to move the sled 32 for wiping the printhead nozzles by the blades 34A, 34B.

An advantage of the system is that the amount of wiping fluid dispensed onto the nozzles can be metered by the controller. This can be done by controlling the length of time the actuator 58 is in operation for a given spray cycle, while also controlling the positioning of the printhead to be over the spray nozzle 52 during the spray operation. It has been found that periodic heavy applications of wiping fluid with repeated subsequent wiping routines can be very effective at cleaning printhead orifice plates and dissolving nozzle plugs. Although not as effective, a wiping routine using smaller amounts of wiping fluid followed by a single wiping procedure is faster.

Each wiping routine need not utilize an application of the wiping fluid. In fact, in many applications, most nozzle wiping procedures will be performed "dry," i.e. without use of the spray system 50 to apply the wiping fluid. The spray system 50 can be employed, for example, on a predetermined periodic basis, or upon user activation, or when the printing system or user detects a nozzle printing defect.

While not illustrated in FIG. 1, the printing system can include a blotter to collect excess spray. Some service stations employ a blotter for collecting debris scraped from the nozzles and the wiper blades, for example, commonly assigned U.S. Pat. No. 6,193,353, and this blotter can also collect the wiping fluid after the wiping routine.

The dispenser nozzle could be integrated into the service station in some embodiments, to minimize space requirements.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A wiping fluid dispensing system for an inkjet printing system employing an inkjet printhead with ink-ejecting nozzles for ejecting droplets of ink, the dispensing system comprising:

a wiping fluid nozzle structure positioned at a dispensing location;

a wiping fluid dispenser apparatus for delivering wiping fluid to the wiping fluid nozzle structure to dispense wiping fluid as a spray or stream onto the printhead nozzles during a cleaning mode; and a fluid seal at or adjacent said wiping fluid nozzle structure through which said dispenser apparatus delivers the wiping fluid to the wiping fluid nozzle structure, said fluid seal minimizing fluid evaporation during periods of non-use of the wiping fluid nozzle structure.

2. The system of claim 1, wherein the wiping fluid dispenser includes a fluid actuator for delivering the wiping fluid to the wiping fluid nozzle structure under pressure to cause the wiping fluid to be dispensed through the wiping fluid nozzle structure as a spray or stream of wiping fluid onto the printhead nozzles.

3. The system of claim 2, wherein the fluid actuator includes a pump for actively pumping said fluid.

4. The system of claim 1, wherein said fluid seal is a check valve having a break pressure.

5. The system of claim 1, further comprising a reservoir for holding a quantity of said wiping fluid, said fluid actuator fluidically coupled to the reservoir.

6. The system of claim 1, wherein the wiping fluid is water or a mixture including water.

7. The system of claim 1, wherein said nozzle structure is positioned relative to the printhead nozzles so that the nozzle structure does not come into contact with the printhead nozzles.

8. A wiping fluid dispensing system for an inkjet printing system employing an inkjet printhead with ink-ejecting nozzles for ejecting droplets of ink, the dispensing system comprising:

a wiping fluid nozzle positioned at a dispensing location to dispense wiping fluid onto the printhead nozzles during a cleaning mode;

a reservoir for holding a quantity of said wiping fluid;

a fluid actuator fluidically coupled to the reservoir for delivering wiping fluid from the reservoir to the wiping fluid nozzle under pressure to cause the wiping fluid to be dispensed through the wiping fluid nozzle as a spray of wiping fluid onto the printhead nozzles;

a fluid seal at or adjacent said wiping fluid nozzle through which said fluid actuator delivers the wiping fluid to the wiping fluid nozzle, said fluid seal minimizing fluid evaporation during periods of non-use of the wiping fluid nozzle.

9. The system of claim 8, wherein said fluid seal is a check valve having a break pressure.

10. The system of claim 8, wherein the fluid actuator includes a pump for actively pumping said fluid.

11. The system of claim 8, wherein the wiping fluid is water or a mixture of water with a surfactant.

12. The system of claim 8, wherein said nozzle structure is positioned relative to the printhead nozzles so that the nozzle structure does not come into contact with the printhead nozzles.

13. An inkjet printing system, comprising:

an inkjet printhead including ink-ejecting nozzles for ejecting droplets of ink;

a scanning carriage for holding the printhead while the carriage is scanned along a scan axis;

a carriage drive system coupled to the carriage for moving the carriage along the scan axis;

a service station for conducting printhead service functions on said printhead, the service station including a wiper system for wiping the ink-ejecting nozzles to remove residue from the nozzles during a wiping operation, and a capping assembly to cap the ink-ejecting nozzles during a capping operation;

a wiping fluid dispensing system comprising a wiping fluid nozzle structure positioned at a dispensing location spatially separated from said capping assembly to dispense wiping fluid onto the printhead nozzles before a wiping operation, and a fluid actuator for delivering the wiping fluid to the wiping fluid nozzle under pressure to cause the wiping fluid to be dispensed through the wiping fluid nozzle structure as a spray or stream of wiping fluid onto the printhead nozzles.

14. The system of claim 13, wherein the fluid dispensing system further comprises a fluid seal at or adjacent said wiping fluid nozzle through which said fluid actuator delivers the wiping fluid to the wiping fluid nozzle, said fluid seal minimizing fluid evaporation during periods of non-use of the wiping fluid nozzle.

15. The system of claim 14, wherein said fluid seal is a check valve having a break pressure.

16. The system of claim 13, wherein the fluid actuator includes a pump for actively pumping said fluid.

17. The system of claim 13, wherein the fluid dispensing system further comprises a reservoir for holding a quantity of said wiping fluid, said fluid actuator fluidically coupled to the reservoir.

18. The system of claim 17, wherein the fluid actuator is fluidically coupled to the reservoir by a tubing structure.

19. The system of claim 13, wherein the wiping fluid is water or a mixture of water with a surfactant.

20. The system of claim 13, wherein said nozzle structure is disposed relative to the printhead nozzles so that the nozzle structure does not come into contact with the printhead nozzles.

21. A method for cleaning printhead ink-ejecting nozzles of an inkjet printhead, comprising:

moving the printhead over a wiping fluid nozzle structure positioned at a service station spatially separated from a capping assembly for capping the printhead nozzles;

dispensing wiping fluid from the wiping fluid nozzle structure onto the printhead nozzles as a spray or stream of wiping fluid onto the printhead nozzles to wet the nozzles with the wiping fluid;

wiping the wetted printhead nozzles with a wiping blade to remove residue from the nozzles.

22. The method of claim 21, wherein the wiping fluid comprises water.

23. The method of claim 21, wherein said dispensing wiping fluid includes:

pumping the wiping fluid through said fluid nozzle structure to emit said spray or stream of wiping fluid.

24. The method of claim 21, wherein said dispensing wiping fluid comprises:

dispensing said wiping fluid through said wiping fluid nozzle structure as a spray or stream onto the printhead nozzles without physically contacting the nozzles with the dispensing structure.

25. The method of claim 21, further comprising:

repeating said dispensing said fluid and said wiping the wetted printhead nozzles in a repetitive cleaning cycle.

26. The method of claim 21, wherein said dispensing said fluid comprises:

dispensing a metered amount of fluid onto said printhead nozzles in a spray cycle.

* * * * *